US010878976B2

(12) United States Patent
She et al.

(10) Patent No.: US 10,878,976 B2
(45) Date of Patent: Dec. 29, 2020

(54) COMPOSITES AND METHODS OF MAKING COMPOSITE MATERIALS

(71) Applicant: Hamilton Sundstrand Corporation, Charlotte, NC (US)

(72) Inventors: Ying She, East Hartford, CT (US); Sameh Dardona, South Windsor, CT (US); Wayde R. Schmidt, Pomfret Center, CT (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 186 days.

(21) Appl. No.: 14/745,004

(22) Filed: Jun. 19, 2015

(65) Prior Publication Data

US 2016/0372228 A1 Dec. 22, 2016

(51) Int. Cl.

| | |
|---|---|
| ***H01B 1/04*** | (2006.01) |
| ***C23C 18/18*** | (2006.01) |
| ***C23C 18/38*** | (2006.01) |
| ***C23C 18/42*** | (2006.01) |

(52) U.S. Cl.

CPC ..... *H01B 1/04* (2013.01); *C23C 18/1882* (2013.01); *C23C 18/1893* (2013.01); *C23C 18/38* (2013.01); *C23C 18/42* (2013.01)

(58) Field of Classification Search

None

See application file for complete search history.

(56) References Cited

U.S. PATENT DOCUMENTS

| | | | | |
|---|---|---|---|---|
| 3,316,124 | A * | 4/1967 | Kronenberg | B01J 23/40 427/113 |
| 2011/0318504 | A1 | 12/2011 | Han et al. | |
| 2013/0309495 | A1* | 11/2013 | Do | C09D 1/00 428/402 |
| 2014/0116258 | A1 | 5/2014 | Bugnano et al. | |
| 2014/0335410 | A1* | 11/2014 | Loveridge | H01M 4/622 429/217 |
| 2014/0363677 | A1 | 12/2014 | Schmidt et al. | |
| 2015/0111022 | A1 | 4/2015 | Birnkrant | |
| 2015/0310957 | A1* | 10/2015 | Qian | H01B 1/04 174/126.2 |
| 2016/0059534 | A1* | 3/2016 | Balachandra | B29C 65/1435 156/151 |
| 2017/0200938 | A1* | 7/2017 | Zhamu | H01M 4/133 |

FOREIGN PATENT DOCUMENTS

| | | | | |
|---|---|---|---|---|
| WO | WO-2011101777 | A1 | 8/2011 | |
| WO | WO 2014114915 | A1 * | 7/2014 | C09J 5/06 |
| WO | WO-2014210584 | A1 * | 12/2014 | H01B 1/04 |

OTHER PUBLICATIONS

Karim et al. Production and characterization of Ni and Cu composite coatings by electrodeposition reinforced with carbon nanotubes or graphite nanoplatelets. Journal of Physics: Conference Series 439 (2013) 012019.*

Cheaptubes COOH Functionalized Graphene Nanoplatelets. Date Unknown.*

Hirata et al. Thin-film particles of graphite oxide. 2: Preliminary studies for internal micro fabrication of single particle and carbonaceous electronic circuits. Carbon. vol. 43, Issue 3, 2005, pp. 503-510 (Year: 2005).*

* cited by examiner

*Primary Examiner* — Tanisha Diggs

(74) *Attorney, Agent, or Firm* — Locke Lord LLP; Scott D. Wofsy; Georgi Korobanov

(57) ABSTRACT

A method of making a composite material includes disposing a carbon-based particulate material, such as graphene or carbon nanotubes, in an activation solution and activating surfaces of the carbon-based particulate material using the activation solution. Once the surfaces of the carbon-based particulate material have been activated a metallic coating is applied to the activated surfaces to form a composite material. The composite material is then recovered as a particulate material formed having carbon-based particulate material with a metallic coating that is suitable for fusing together for forming electrical conductors, such as with an additive manufacturing technique.

20 Claims, 5 Drawing Sheets

Table 1:
Composition of Activation Solutions

| Chemicals | Formula | Concentration |
|---|---|---|
| Tin dichloride anhydrous | $SnCl_2$ | 1 g/L |
| Chloric acid (37 wt.%) | HCl | 1 ml/L |
| | | |
| Pd chloride | $PdCl_2$ | 0.1 g/L |
| Chloric acid (37 wt.%) | HCl | 1 ml/L |

FIG. 7

Table 2:
Composition of Copper Electroless Plating Bath

| Chemicals | Formula | Concentration (grams/L) |
|---|---|---|
| Copper(II) sulfate pentahydrate | $CuSO_2$ $5H_2O$ | 16.67 |
| EDTA 2Na $2H_2O$ | $C_{10}H_{14}N_2Na_2O_8 2H_2O$ | 13.45 |
| Hydrazine | $N_2H_4$ | 1.28 |
| Temperature | ~40° C | |
| pH | ~12 | |

FIG. 8

COMPOSITES AND METHODS OF MAKING COMPOSITE MATERIALS

BACKGROUND OF THE INVENTION

1. Field of the Invention

The present disclosure relates generally to additive manufacturing, and more particularly to particulate materials for additive manufacturing techniques.

2. Description of Related Art

Aircraft commonly employ electrical and electromagnetic components such as motors, inductors, sensors, and power distribution systems. Such electrical and electromagnetic components often include electrical conductors. The electrical conductors generally include etchings, laminations, windings or other structures formed from an electrically conductive material with geometry suitable for the type of electrical power intended to be applied to the electrical conductor. The material is typically selected for a specific property or set of properties, such as electrical conductivity, thermal conductivity, dielectric strength, or magnetic permeability. Such conductors commonly include copper or copper alloys owing to the generally favorable properties of such materials. In some applications electrical and electromagnetic components formed by such materials may operate relatively close to the maximum ampacity of the material forming the electrical conductor. Such electrical conductors may also be relatively heavy due to the use of bulk copper, particularly in relatively high current applications contemplated in some types of aircraft electrical systems.

Such conventional electrical and electromagnetic components and methods of making electrical components have generally been considered satisfactory for their intended purpose. However, there is still a need in the art for improved electrical and electromagnetic components. The present disclosure provides a solution for this need.

SUMMARY OF THE INVENTION

A method of making a composite material includes disposing a carbon-based particulate material, such as graphene platelets, in an activation solution, and activating surfaces of the carbon-based particulate material using the activation solution. Once the surfaces of the carbon-based material are activated a metallic coating is applied to the activated surfaces, thereby forming a composite material. The composite material is then recovered as a particulate, the particles forming the particulate material having carbon-based particle bodies with a metallic coating that are suitable for fusing together to form electrical conductors using an additive manufacturing technique.

In certain embodiments, the carbon based particulate material includes graphene particulate. The graphene particulate includes one or more graphene platelets with a plate-like body and having a metallic coating. The plate-like body can have an irregular shape. The plate-like body can define a hole, a cavity, or a depression. The plate-like body can have one or more edges. The composite material can form a relatively fine particulate material, and may include either or both micro and nanoparticles.

In accordance with certain embodiments, the metallic coating can extend over substantially the entire surface of the one or more graphene platelets. The metallic coating may have a uniform thickness over the surface of the graphene platelet. The metallic coating can be fixed to features defined by the graphene platelet, such as the holes, cavities, depressions, and/or edges. The metallic coating can include an electrically conductive material, such as copper, gold, or any other suitable electrically conductive material. The composite material may have greater ampacity than a copper-containing conductor, may be less dense than bulk copper or copper-containing alloys, and may be more dense than the constituent graphene particulate.

It is also contemplated that, in accordance with certain embodiments, the composite material can be integrated (e.g. fused) to form an electrical conductor. The electrical conductor can be a discrete structure, such as a wire or winding for an electrical component of an aircraft electrical system. The electrical conductor can form a layer, such as a foil, for a circuit board. In certain embodiments the layer (or foil) can form a conductor for a high current capacity device, and can have a current rating from 5 to 15 amps or any suitable range. The conductor can be integral with a component of an electrical system, such artwork defined on a printed circuit board or within circuitry of a solid-state device. The electrical conductor may be formed from the composite material using an additive manufacturing process, such as with laser engineering net shaping, a laser fusing, electron beam fusing, powder bed fusion, cold spray, kinetic metallization, wire arc, or any other suitable additive manufacturing technique.

In another aspect, a method of making a composite material includes disposing a carbon-based particulate material, such as graphene platelets or carbon nanotubes, in an activation solution. Surfaces of the carbon-based particulate material are then activated using the activation solution. A metallic coating is thereafter developed (or applied) to the activated surfaces of the carbon-based particulate material.

In embodiments, the activation solution(s) can include tin dichloride and/or palladium chloride. Activating surfaces of the carbon-based particulate material can include using a plurality of activation solutions, such as by sequentially disposing the carbon-based particulate material in first activation solution including a tin dichloride solution, and thereafter disposing the carbon-based particulate material in a second activation solution including a palladium chloride solution. Subsequent to disposing the carbon-based particulate material in the one or more activation solutions the material can be removed from the activation solution, such as by filtering, rinsed, such as with de-ionized water, and/or dried to remove the de-ionized water (and/or residual activation solution) from the carbon-based particulate material.

In accordance with certain embodiments, applying the metallic coating to the carbon-based particulate material can include coating the carbon-based particulate material using an electroless plating technique. Applying the metallic coating can include disposing the carbon-based particulate material with activated surfaces in a plating solution, and agitating the mixture for a predetermined period of time. The plating solution can include copper (II) sulfate pentahydrate, disodium ethylenediaminetetraacetate dihydrate, and hydrazine, and applying the metallic coating can occur within a temperature range between 30 and 50 degrees Celsius, and in an exemplary embodiment at about 40 degrees Celsius. The plating solution may have a pH that is between 10.5 and 13, and in exemplary embodiment can have a pH of about 12. The metallic coating can be a first metallic coating, and the method can further include applying a second metallic coating over the entire first metallic coating, such as by (a) activating the surface of the first metallic coating in one or more activation solutions as described above, (b) disposing the metallic coated carbon-based particulate material in a second plating solution, and (c) developing the second coating using an electroless plating technique.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein:

FIG. 7 is a table showing compositions of exemplary activation solutions, according to an embodiment; and FIG. 8 is a table showing composition of an exemplary plating solution, according to an embodiment.

DETAILED DESCRIPTION OF THE PREFERRED EMBODIMENTS

Figure 1:
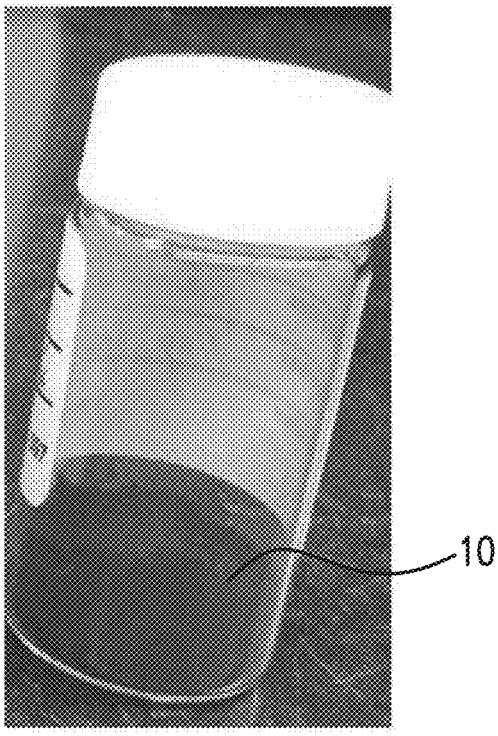
FIG. 1 is a perspective view of an exemplary embodiment of a composite material, showing a carbon-based particulate material with a metallic coating.

Reference will now be made to the drawings wherein like reference numerals identify similar structural features or aspects of the subject disclosure. For purposes of explanation and illustration, and not limitation, a partial view of an exemplary embodiment of a composite material in accordance with the disclosure is shown in FIG. 1 and is designated generally by reference character 10. Other embodiments of composite materials, electrical conductors, and methods of making such composite materials and electrical conductors in accordance with the disclosure, or aspects thereof, are provided in FIGS. 2-8, as will be described. The composite materials, electrical conductors, and methods of making such composite material and electrical conductors described herein can be used for electrical systems and components for aircraft.

Figure 2:
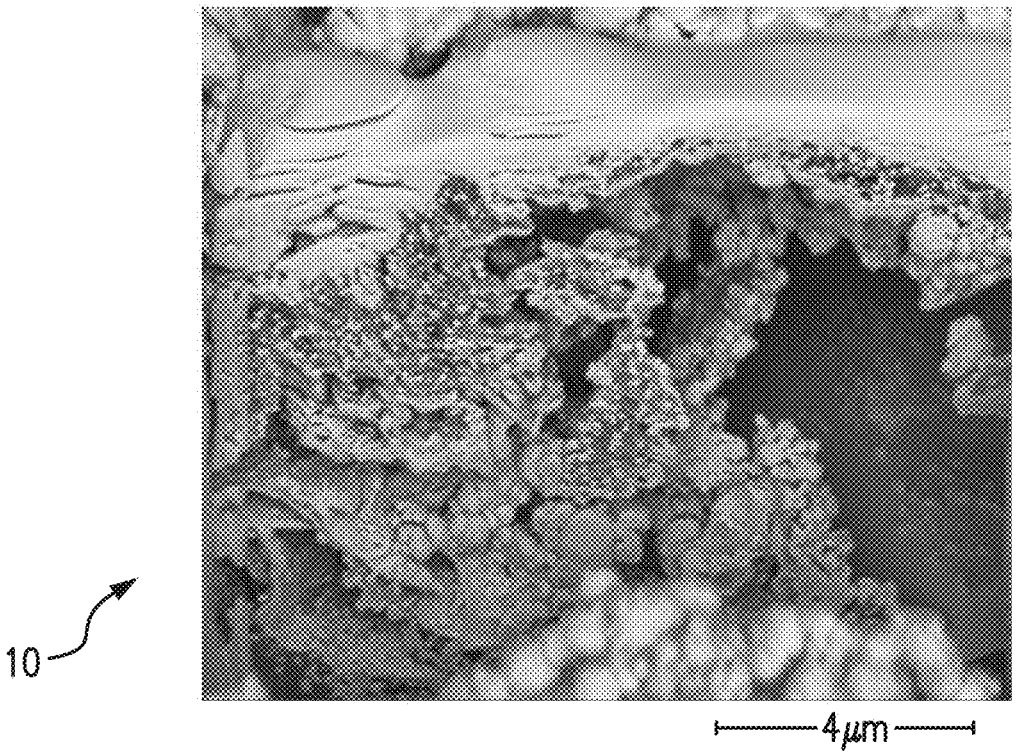
FIG. 2 is a sectional view of a sample of the carbon-based particulate material with a metallic coating of FIG. 1, showing the particulate and metallic coating.
Figure 3:
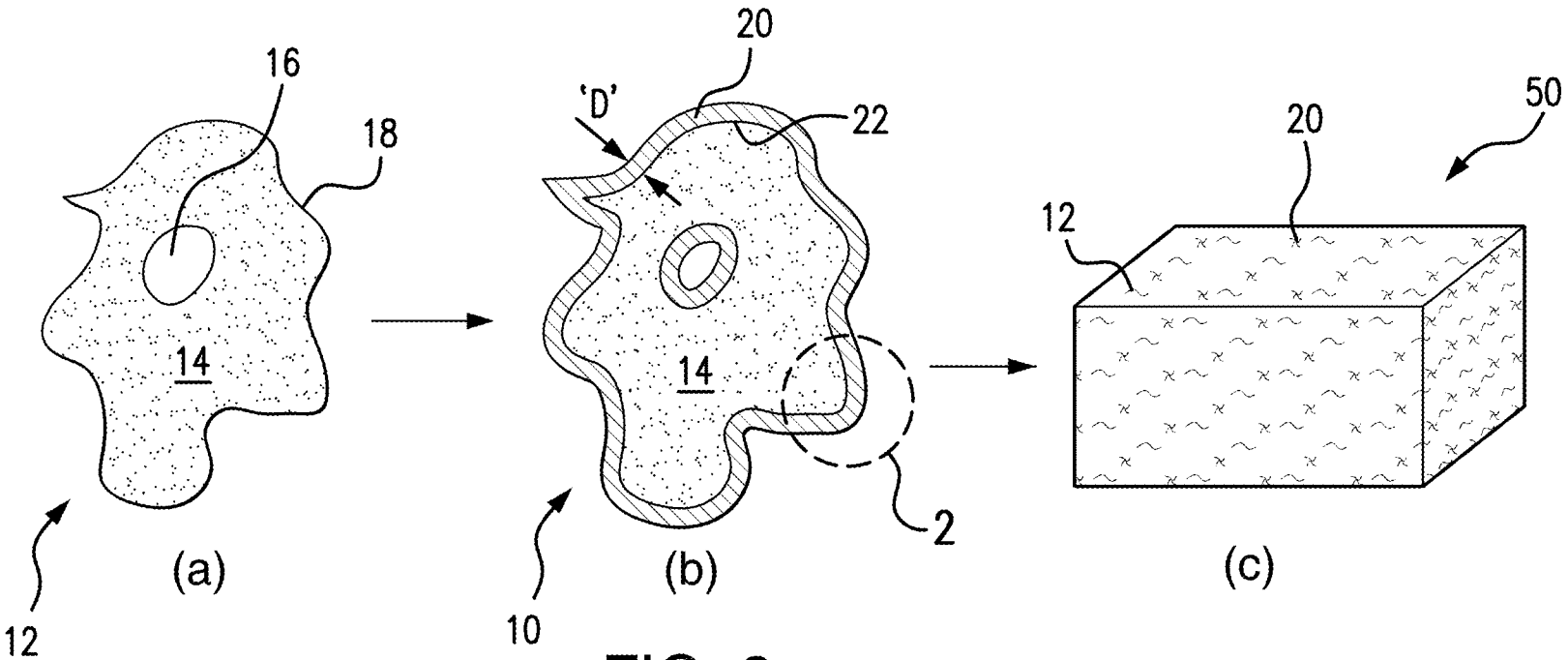
FIG. 3 is a schematic view of a particle of the composite material of FIG. 1, showing a graphene platelet, a graphene platelet with a metallic coating, and a conductor formed using graphene platelets with metallic coatings.

Referring now to FIGS. 1-3, composite material 10 is shown. Composite material 10 generally includes a particulate substrate, such as plurality of graphene bodies 12 with a metallic coating 20. The particulate material can be used to form a composite conductor 50. Composite conductor 50 has an ampacity that is greater than bulk copper. Composite conductor 50 may also be less dense than bulk copper and/or other conventional copper alloys. Although the particulate substrate is described herein as a plurality of graphene bodies, it is contemplated that the particulate substrate may also include fullerene, carbon black, carbon fibrils, carbon nanotubes, or any other suitable carbon based particulate material.

Graphene bodies 12 each have a respective platelet body 14. Platelet body 14 includes one or more holes (or cavities) 16 that extend through platelet body 14. Platelet body 14 also has one or more edges 18 defined at a periphery of platelet body 14 and/or hole (or cavity 16). At the outer periphery of platelet body 14 edge 18 traces an irregular shape and bounds a plate-like body, which is illustrated in an exaggerated, two-dimensional form in FIG. 3. Although described herein as a graphene platelet, it should be understood that graphene body 12 may be a platelet, a nanotube, or a macro structure such as a sheet and or rod.

Composite material 10 includes a metallic coating 20 is disposed over a surface 22 of platelet body 14. Surface 22 includes the area of platelet body 14, edge 18, and the portions of platelet body 14 bounding hole (or cavity) 16. Metallic coating 20 has a coating thickness D that is substantially uniform over the entire surface of platelet body 14—including surface 22, edge 18, and the interior of hole (or cavity) 16. It is contemplated that coating 20 is a monolayer with a thickness of about fifty (50) microns. As indicated in the progression indicated with reference letters A-C, it is contemplated that the graphene platelets (shown in A) have coating 20 be applied (shown in B) and that the coated platelet bodies are thereafter be integrated into a composite conductor 50 (shown in C). Composite conductor 50 may be a discrete structure for an aircraft electrical system, such as a wire or cable. Alternatively, composite conductor 50 may be integrally formed with an electronic component such as artwork formed on a printed circuit board or feature defined within a solid-state device.

Figure 4:
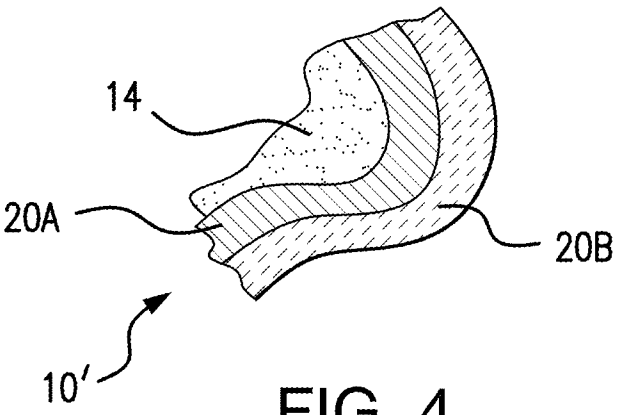
FIG. 4 is a schematic view of the composite material of FIG. 3, showing first and second metallic coatings on a graphene platelet.

Referring to FIG. 4, a composite material 10' is shown. Composite material 10' is similar to composite material 10, and additionally includes a plurality of metallic coatings. In this respect composite material 10' includes a first metallic coating 20A and a second metallic coating 20B. First metallic coating 20A overlays the surface of platelet body 14. Second metallic coating 20B overlays the surface of first metallic coating 20A and is also disposed over substantially the entire surface of platelet body 14. It is contemplated that for either or both first metallic coating 20A and second metallic coating 20B include a metallic electrical conductor, such as copper or gold. It is also contemplated that the metallic coatings can be the same material, such as copper, and that more than two coatings can be applied to platelet body 14. Alternatively, first metallic coating 20A and second metallic coating 20B may include different materials, as suitable for a given application.

Figure 5:
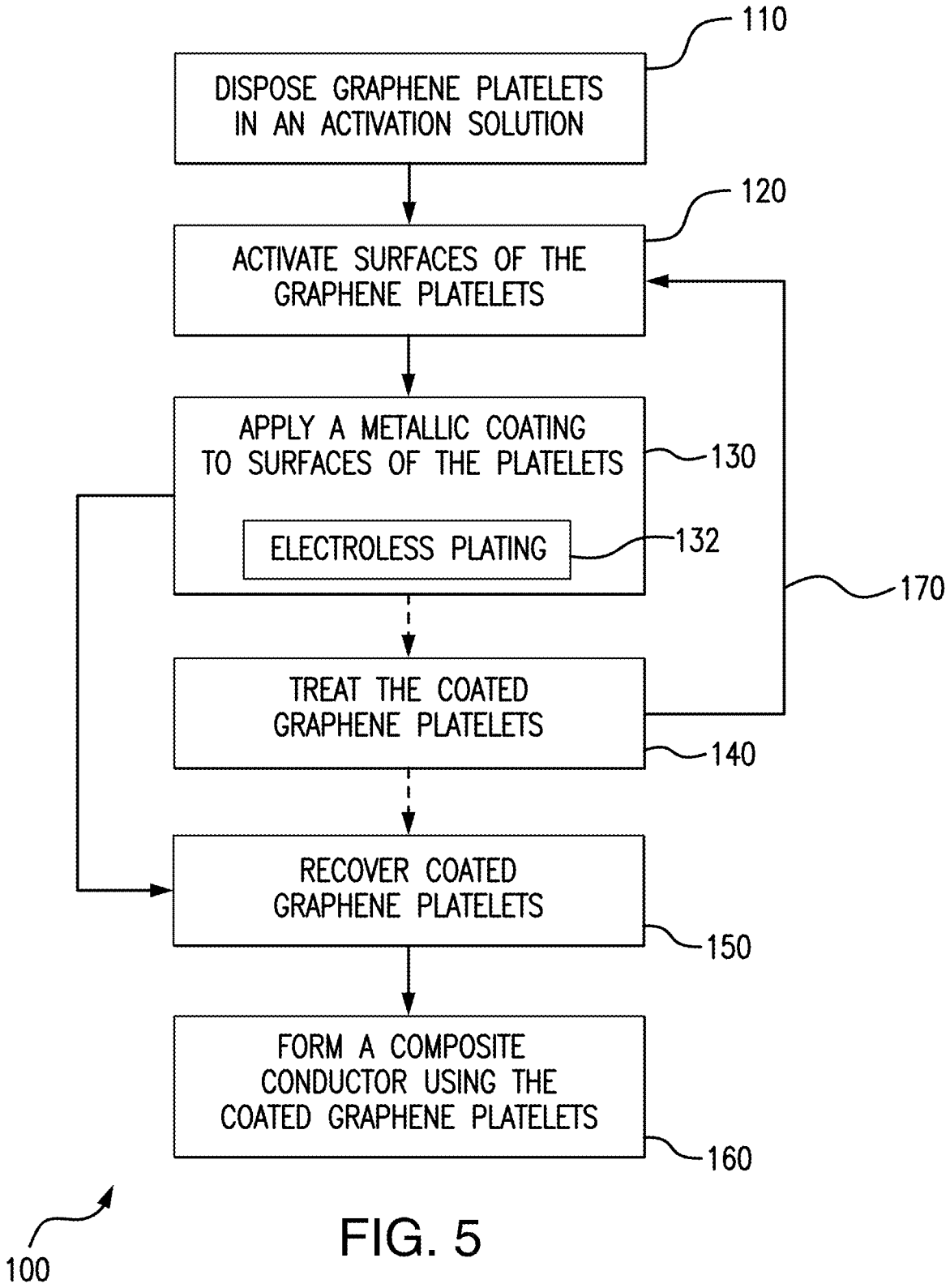
FIG. 5 shows a method a making a composite material, showing steps for activating surfaces and applying a metallic coating to the activated surfaces of the graphene platelets.

With reference to FIG. 5, a method of making a composite material 100 is shown. Method 100 includes disposing graphene platelets, e.g. graphene platelets 12 (shown in FIG. 3), in an activation solution, as shown with box 110. The activation solution may include tin chloride and/or palladium chloride, and in certain embodiments may include sequentially disposing the graphene platelets within a first activation solution including a tin chloride solution and a second activation solution including a palladium chloride solution for predetermined time intervals, e.g. for several minutes, for purposes of making surfaces of the graphene platelets, e.g. surface 22 (shown in FIG. 3), amenable for coating with a metallic coating, e.g. metallic coating 20 (shown in FIG. 3), as shown with box 120.

Once the surfaces of the graphene platelets have been activated the metallic coating is applied to the graphene platelets, as shown with box 130. The metallic coating can be applied using an electroless plating technique, as shown with box 132, and can be applied such that uniform metallic coating or predetermined thickness is fixed to (and overlays) the graphene platelet body. Electroless plating exploits a redox reaction that can deposit metals such as elemental copper upon particulate substrates such as graphene platelets without using an electrical current. Electroless plating allows for depositing copper evenly along edges, inside holes and over irregularly shaped features presented by the graphene platelets to provide a uniform metallic coating. Advantageously, deposition may occur over substantially the entire body, which can be advantageous for materials including graphene where the ratio of surface area to mass is relatively high. In embodiments, coating the graphene platelets may include disposing the activated graphene platelets in a plating solution for a predetermined time interval, e.g. 1-2 hours. In certain embodiments, the activated graphene platelet-activation solution mixture is agitated (stirred) to facilitate development of the coating over activated surfaces of the graphene platelets.

Once the metallic coating has been developed on activated surfaces of the graphene platelets the platelets are treated, as shown with box 140. This may include rinsing the coated graphene platelets using de-ionized water. It may also include drying the coated the graphene platelets to accelerate removal of the de-ionized water and/or residual plating solution from the coated graphene platelets. As also indicated by arrow 170, surface activation, application of the coating, and post-coating treatment can be iteratively repeated for purpose of developing a coating of suitable thickness—thereby controlling the ratio of metal to graphene in the resulting composite material.

Optionally, method 100 can also include recovery of the coated graphene platelets to produce a powdered particulate material, as shown with box 150. The powdered particulate material can be used to form a composite conductor, e.g. composite conductor 50 (shown in FIG. 3), as shown with box 160. Forming the composite conductor may include using an additive manufacturing process, such as a laser engineering net shaping method, powder bed fusing using a laser or electron beam energy source, cold spray, kinetic metallization, wire arc, or any other suitable additive manufacturing process.

Figure 6:
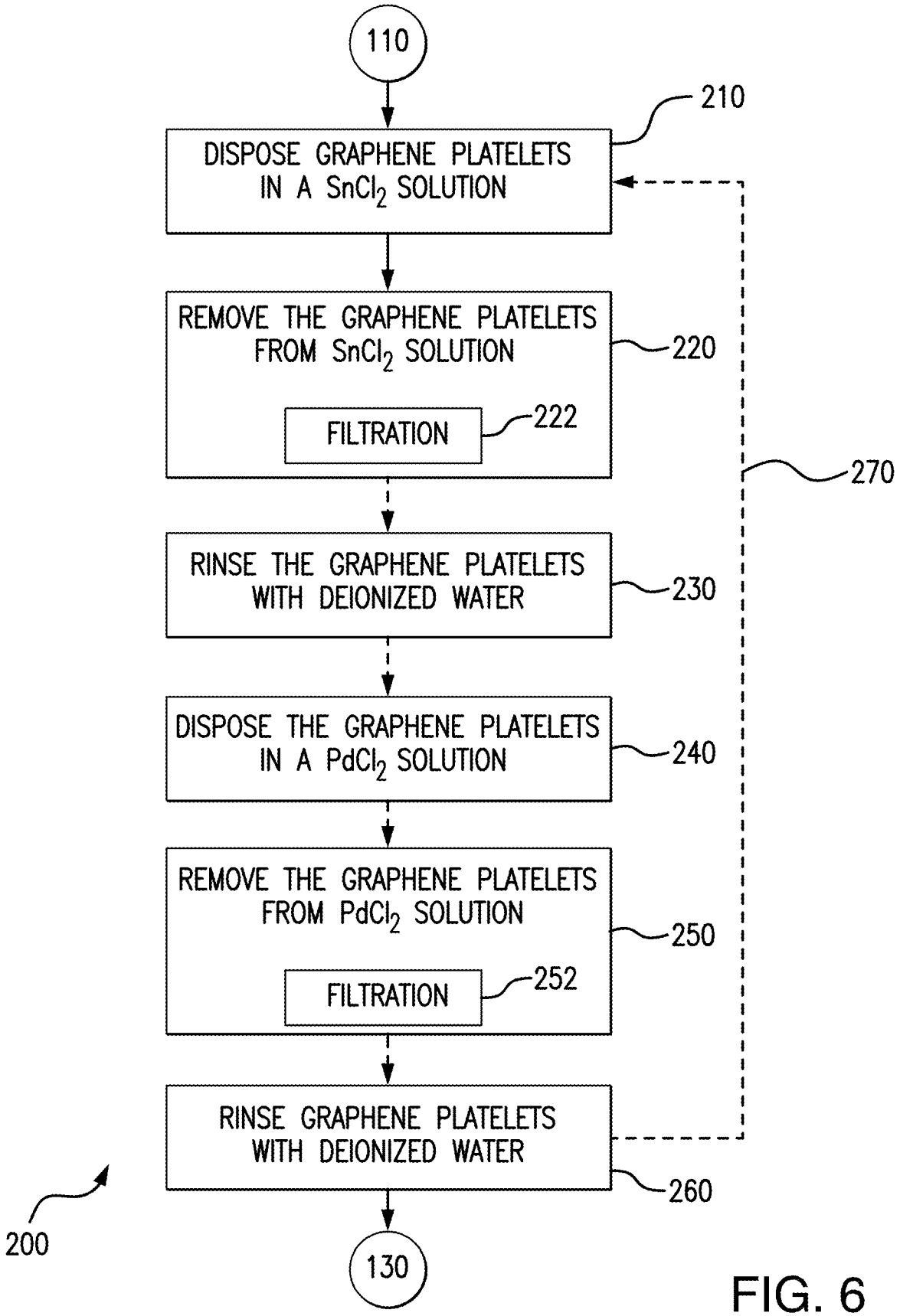
FIG. 6 shows activation of the graphene platelet surfaces using tin dichloride and palladium chloride solutions, according to an embodiment.

Referring now to FIG. 6, a method of making a composite material 200 is shown. Method 200 is similar to method 100 and includes at least a first surface activation operation, shown with box 210, generally entailing disposing the graphene platelets in a tin chloride solution. After a predetermined time interval (typically several minutes) the graphene platelets are removed from the tin chloride activation solution, as shown by box 220. Removal can include filtration, as shown with box 222. The graphene platelets may thereafter be rinsed with de-ionized water and dried, as shown with box 230.

Optionally, method 200 may include two or more surface activation steps. For example, subsequent to the disposing the graphene platelets in the tin chloride activation solution, the graphene platelets may be disposed in a palladium chloride solution, as shown with box 240. After a predetermined time interval (typically several minutes) the graphene platelets can then be removed from the palladium chloride activation solution, as shown with box 250. Removal of the activated graphene platelets may include further filtration, as shown with box 252, and further rinsing and/or drying, as shown with box 260. Either or both to the surface activation operations may be repeated iteratively, as indicated by arrow 270, such that surfaces of the graphene platelets can be suitably condition for application of the metallic coating.

In an exemplary embodiment of method 200, a predetermined amount of graphene platelets are activated by successive exposures to a relatively dilute tin chloride solution and a relatively dilute palladium chloride solution—activating surfaces of the graphene platelets and rendering them amenable to coating.

With reference to FIG. 7, example compositions of the activation solution are shown. The activation solution can be a tin chloride activation solution, such as anhydrous tin dichloride ($SnCl_2$) with a concentration of about one gram per liter, and hydrochloric acid with a concentration of about one milliliter per liter forming about 37% of the solution. The activation solution can be a palladium chloride activation solution, such as a palladium dichloride ($PdCl_2$) with a concentration of about 0.001 to about one (1) gram per liter, and hydrochloric acid (HCl) with a concentration about one milliliter per liter forming about 37% of the solution. In an exemplary embodiment the concentration of the activation solution is about 0.1 grams per liter. It is contemplated that surface activation can include sequentially treating the carbon-based particulate material surfaces to a tin chloride activation solution and then a palladium chloride activation solution.

Returning to FIG. 6, applying the metallic coating can include mixing the activated graphene platelets in the copper electroless plating solution for a predetermined time interval, such that a metallic coating of uniform thickness deposits on the activated surfaces of the graphene particles. Optionally, this can include mechanical agitation.

With reference to FIG. 8, an exemplary embodiment of electroless plating bath includes copper (II) sulfate pentahydrate ($CuSO_45H_2O$), disodium ethylenediaminetetraacetate dihydrate (EDTA $2Na{\cdot}2H_2O$) ($C_{10}H_{14}N_2Na_2O_82H_2O$), and hydrazine ($N_2H_4$) in concentrations of about 16.67, 13.45, and 1.28 grams per liter, respectively. Coating deposition can occur while the solution is maintained at a pH of about 12 and at a temperature of about 40 degrees Centigrade.

Coated graphene particles are then available for extraction from the plating solution that have a density that is greater than graphene, have ampacity similar to that of graphene, and have electrical conductivity similar to that of bulk copper. Once recovered from the plating solution, the coated graphene platelets can form a composite material suitable as feedstock for an additive manufacturing process, such as laser engineered net shaping, laser fusion, powder bed fusion, electron beam fusion, laser sintering, cold spray, kinetic metallization, wire arc or other suitable additive manufacturing techniques. Advantageously, the input energy from certain additive manufacturing techniques enables densification of the powder while forming a functional structure or article (e.g. a discrete or integrated composite conductive structure).

The methods and systems of the present disclosure, as described above and shown in the drawings, provide for conductors with superior properties including reduced size and weight for a given ampacity in relation to bulk copper or copper alloy conductors. The conductors have the electrical properties of graphene (i.e. high ampacity) and copper (i.e. high electrical conductivity), and may further provide improved thermal conduction and/or reduced voltage drop relative to bulk copper or copper alloy conductors. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. An electrical conductor, comprising:

a fused composite material consisting of carbon-based particulate bodies with metallic coatings, wherein the carbon-based particulate bodies are a plurality of graphene platelet bodies having an irregular shape, wherein the carbon-based particulate bodies have one or more holes extending throughout each particulate body, wherein the electrical conductor has an ampacity that is greater than a dimensionally identical conductor that is formed from bulk copper.

2. The electrical conductor as recited in claim 1, wherein the plurality of graphene platelet bodies have at least one edge.

3. The electrical conductor as recited in claim 2, wherein the metallic coating extends over the graphene platelet body in a uniform thickness.

4. The electrical conductor as recited in claim 1, wherein the metallic coating selected from the group consisting of copper or gold.

5. A composite conductor, comprising:

a wire, a cable, or artwork formed on a printed circuit board (PCB) having:

a surface; and an interior enveloped by the surface, the surface and the interior consisting of carbon-based platelet bodies with copper coatings fused to one another, wherein the carbon-based platelet bodies each have one or more holes or cavities extending through each platelet body, and wherein the composite conductor has an ampacity that is greater than a dimensionally identical electrical conductor formed from bulk copper.

6. A composite conductor, comprising:

a wire, cable or artwork formed on a printed circuit board (PCB) having:

a surface; and an interior enveloped by the surface, the surface and the interior consisting of carbon-based bodies with metallic coatings fused to one another, wherein the carbon-based particulate bodies are a plurality of graphene platelet bodies having an irregular shape, wherein the carbon-based particulate bodies have one or more holes extending through each body, and wherein the composite conductor has an ampacity that is greater than a dimensionally identical electrical conductor formed from bulk copper.

7. The composite conductor as recited in claim 6, wherein the composite conductor is less dense than bulk copper.

8. The composite conductor as recited in claim 6, wherein metallic coating is copper.

9. The composite conductor as recited in claim 6, wherein the metallic coating consists of a first metallic material and a second metallic material.

10. The composite conductor as recited in claim 6, wherein the metallic coating consists essentially of copper and a second metallic material.

11. The composite conductor as recited in claim 6, wherein the metallic coating is a monolayer having a thickness of about 50 microns.

12. The composite conductor as recited in claim 6, wherein the composite conductor is a wire for an aircraft electrical power distribution system.

13. A method of making a composite material as recited in claim 1, the method comprising:

disposing the carbon-based particulate body in an activation solution;

activating surfaces of the carbon-based particulate body while in the activation solution; and applying the metallic coati ng to the activated surfaces of the carbon-based particulate body.

14. A method as recited in claim 13, wherein the activation solution comprises at least one of tin chloride and palladium chloride.

15. A method as recited in claim 13, wherein the activation solution is a first activation solution and the method further include disposing the graphene body in a second activation solution.

16. A method as recited in claim 15, wherein the method further includes removing the first activation solution from the graphene body prior to disposing the carbon-based particulate body in the second activation solution.

17. A method as recited in claim 13, further including filtering the activation solution to remove the carbon based particulate body from the activation solution.

18. A method as recited in claim 13, wherein applying the metallic coating to the carbon-based particulate body comprises coating the body using an electroless plating technique.

19. A method as recited as recited in claim 18, wherein applying the metallic coating includes disposing the carbon-based particulate body in a plating solution and agitating the mixture for a predetermined period of time.

20. A method as recited in claim 13, wherein the metallic coating is a first coating, and further including applying a second metallic coating by (a) activating the surface of the first metallic coating, and (b) disposing the coated carbon-based particulate body in a second plating solution.

* * * * *